US010849449B2

(12) United States Patent
Atkinson

(10) Patent No.: US 10,849,449 B2
(45) Date of Patent: Dec. 1, 2020

(54) VARIABLE SIZE MARKER FOR A GARMENT HANGER

(71) Applicant: Hangerlogic Inc., LaSalle (CA)

(72) Inventor: Kevin Atkinson, Woodbridge (CA)

(73) Assignee: HANGERLOGIC INC., LaSalle (CA)

( * ) Notice: Subject to any disclaimer, the term of this patent is extended or adjusted under 35 U.S.C. 154(b) by 95 days.

(21) Appl. No.: 16/353,169

(22) Filed: Mar. 14, 2019

(65) Prior Publication Data

US 2019/0290042 A1 Sep. 26, 2019

Related U.S. Application Data

(60) Provisional application No. 62/645,283, filed on Mar. 20, 2018.

(51) Int. Cl.
*A47G 25/14* (2006.01)

(52) U.S. Cl.
CPC ..... *A47G 25/1407* (2013.01)

(58) Field of Classification Search
CPC ..... A47G 25/14; A47G 25/1407; A47G 25/1414; A47G 25/1421; A47G 25/1425; A47G 25/1435
USPC ..... 223/85; 40/322
See application file for complete search history.

(56) References Cited

U.S. PATENT DOCUMENTS 5,664,710 A * 9/1997 Lam ..... A47G 25/1407 223/85
5,727,718 A * 3/1998 Lam ..... A47G 25/20 223/85
6,409,057 B1 * 6/2002 Kim ..... A47G 25/1407 223/85
9,867,487 B2 * 1/2018 Kirkwood ..... A47G 25/32

* cited by examiner

*Primary Examiner* — Nathan E Durham
*Assistant Examiner* — F Griffin Hall
(74) *Attorney, Agent, or Firm* — Mila Shvartsman

(57) ABSTRACT

A variable size marker or sizer for garment hangers is disclosed. A gear-shaped wheel with cogs has various size indicia on each cog, and is inserted into a hanger to display the correct size indicia. The hanger has tabs to retain the sizer in place by mating with slits in the sizer. For example, if a displayed garment is size 'large', the user chooses the cog with "L" facing upwardly, and inserts the sizer into the hanger through the bottom of the hanger until the hanger's tabs click into the sizer's slits corresponding with the "L". The "L" is then visible at the top of the hanger. The hanger is made of resilient material to flex outwardly to allow the sizer to be inserted and removed, yet hold the sizer in place when the hanger is in use.

20 Claims, 4 Drawing Sheets

VARIABLE SIZE MARKER FOR A GARMENT HANGER

This application claims the priority of U.S. Provisional Patent application No. 62/645,283, filed on Mar. 20, 2018.

The present invention relates to a variable size marker for garment hangers. Most garment retail stores use a size marker, known as a "sizer", on a hanger to inform the customer of the size of the garment on that hanger. The sizer makes selecting the correct size easy, and also helps to organize the garments on the racks into size categories. The present invention can display a multitude of variable sizes, depending how it is installed on a garment hanger.

BACKGROUND

Typical sizers show only one size, such as "S", "M" or "L". These sizers are small and easily lost by store personnel when changing a sizer on a hanger. They also get thrown into a general bin with other sizers, and store personnel have to hunt for the correct sizer in the bin. This is time-consuming and not environmentally friendly, as the small sizers make their way to the trash and contribute to the growing amount of waste plastic.

It would be beneficial for the retail garment industry to use a hanger with a variable sizer that can display several indicia depending on the garment it's supporting. There is known U.S. Pat. No. 9,867,487 for a "Hanger Accessory Device" that discloses a hanger with a housing that can display six different indicia. This device records how many times a garment has been worn. Once the user gets to six times, the garment is laundered. This device cannot be adapted for the retail garment industry because the housing can be easily tampered with on purpose or by accident, and thus potentially display the incorrect indicia.

There is also known U.S. Pat. No. 6,409,057 for a "Garment Hanger with Size Window." This invention equally solves the same problems as the present application, but is far more complicated and expensive to manufacture and use. It requires a spring and complex assembly of three distinct parts, whereas the present invention is simple and elegant, requiring only one part.

OBJECT OF THE PRESENT INVENTION

The present invention is a variable size indicator for a garment hanger. The object of this invention is to optimize efficiency of a garment retail store that displays clothing on hangers. Staff tasked with putting clothes on hangers must match a hanger with the garment's size. This makes shopping easier for consumers, and is an expected feature of any clothing store.

There is no guarantee that the size of the garment a staff member has to hang matches the size marker on the hanger. The person has to remove the old size marker, known as sizer, and install the correct size marker. Typically, the person will throw the old sizer into a bin and extract the correct sizer from that bin. If there are six different sizers to choose from, the person has to locate the right sizer. Sometimes sizers get lost and the person will be unable to find the right sizer. This creates a problem, since the garment cannot be hung with a wrong sizer, and the person's frustration of not finding the right sizer causes a domino effect of lost time.

The present invention solves this problem by offering the staff member a gear-shaped element comprising indicia 11 of sizes to choose from. If the garment to be hung is not of the same size as the indicia 11 displayed on the present invention's sizer, the staff member simply pops the sizer out of the hanger, locates the correct indicia 11, and pops the sizer back into the hanger so that it displays the right size for the clothing.

There is no hunting for the right sizer, the indicia 11 change of the present invention takes less time than swapping different sizers from a sizer 4 bin, and losing the sizers of the present invention is more difficult because they are bigger and harder to misplace.

DETAILED DESCRIPTION OF THE PREFERRED EMBODIMENT

The present invention relates to a variable size marker 4 for a garment hanger. The size marker 4 is adapted to display a multitude of indicia 11 depending on the garment to be displayed on the hanger. The size marker 4 is visible from every angle when the hanger is hung on the rack. In the preferred embodiment, the size marker 4 can show six different indicia 11, but the present invention is not limited to six.

Figure 1:
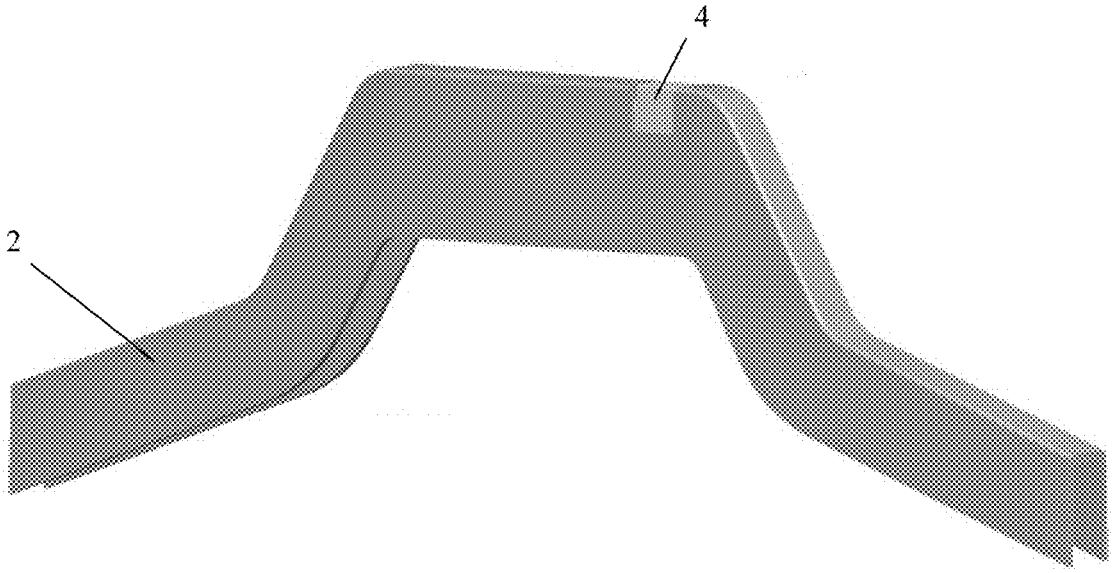
FIG. 1 shows a perspective view of the present invention.
Figure 2:
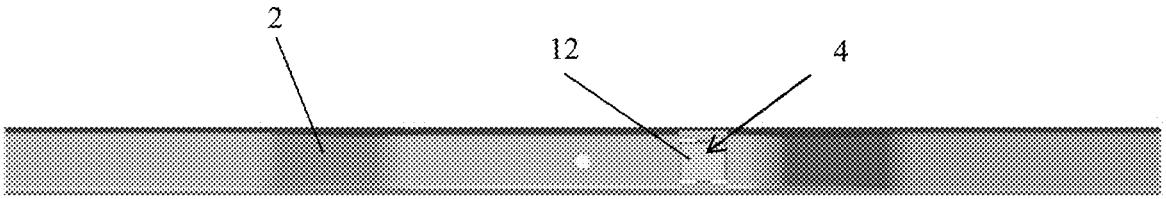
FIG. 2 shows the top view of FIG. 1.
Figure 3:
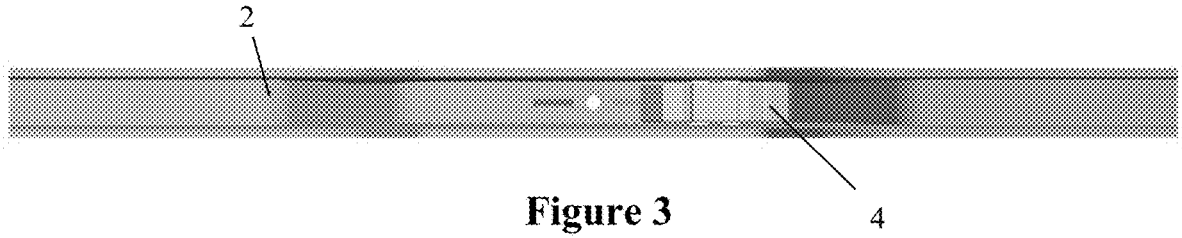
FIG. 3 shows the bottom view of FIG. 1.

Referring now to drawings, FIG. 1 shows a perspective view of the present invention, comprising a hanger 2 and size marker or sizer 4 displayed on substantially the top portion of the hanger. The displayed sizer 4 is in a substantially gear-shaped configuration. In cross-section, said hanger 2 is of an upside-down U configuration. Hanger 2 is made of an elastic material that can flex such as plastic. FIG. 2 shows the top view of the hanger 2 and sizer 4 displaying indicia 11. FIG. 3 shows the bottom view of hanger 2 and sizer 4.

Figure 4:
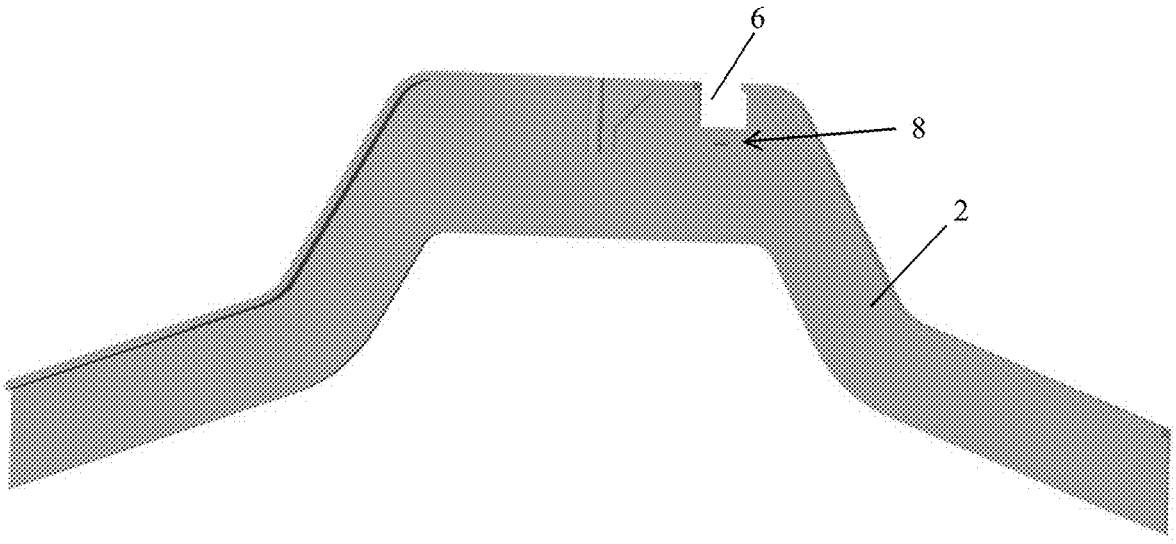
FIG. 4 shows a cut-away view of FIG. 1.

FIG. 4 shows a cut-away view of the hanger 2, the square opening 6 in an upper portion of hanger 2 for sizer 4, as well as one of the tabs 8 inside hanger 2. Tabs 8 are substantially horizontal flat rectangles protruding opposite each other from hanger 2's inside walls below opening 6.

Figure 5:
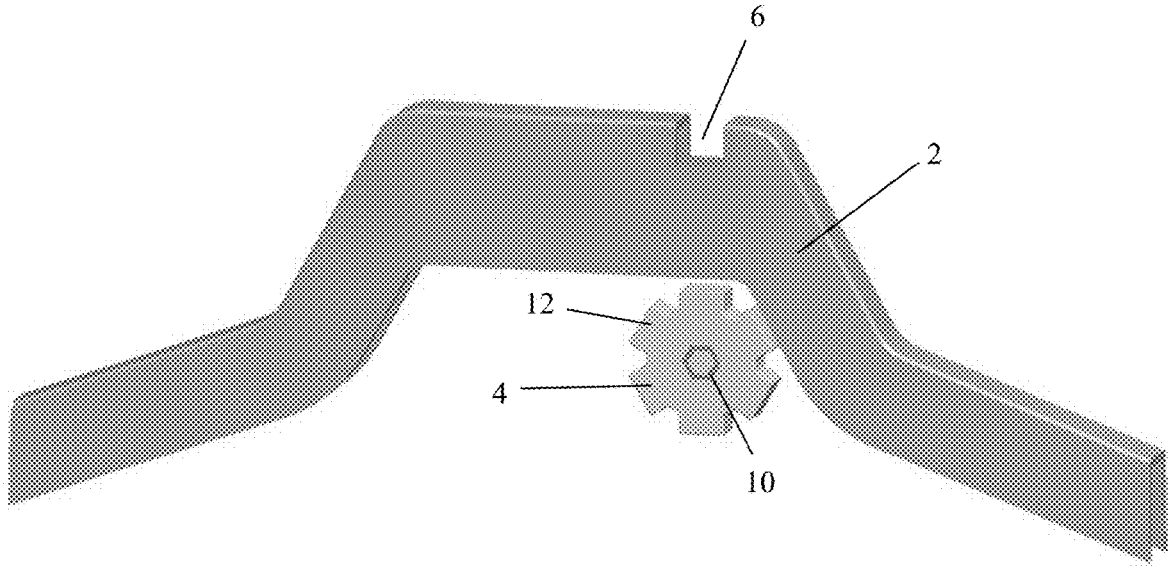
FIG. 5 shows a perspective view of the variable sizer in relation to the hanger.

FIG. 5 shows sizer 4 underneath hanger 2. In the preferred embodiment, sizer 4 is in a configuration of a gear, with six rectangular cogs or protrusions 12 for indicia 11, spaced equidistantly around the periphery of said sizer 4 and extending from a central disk of sizer 4.

Figure 6:
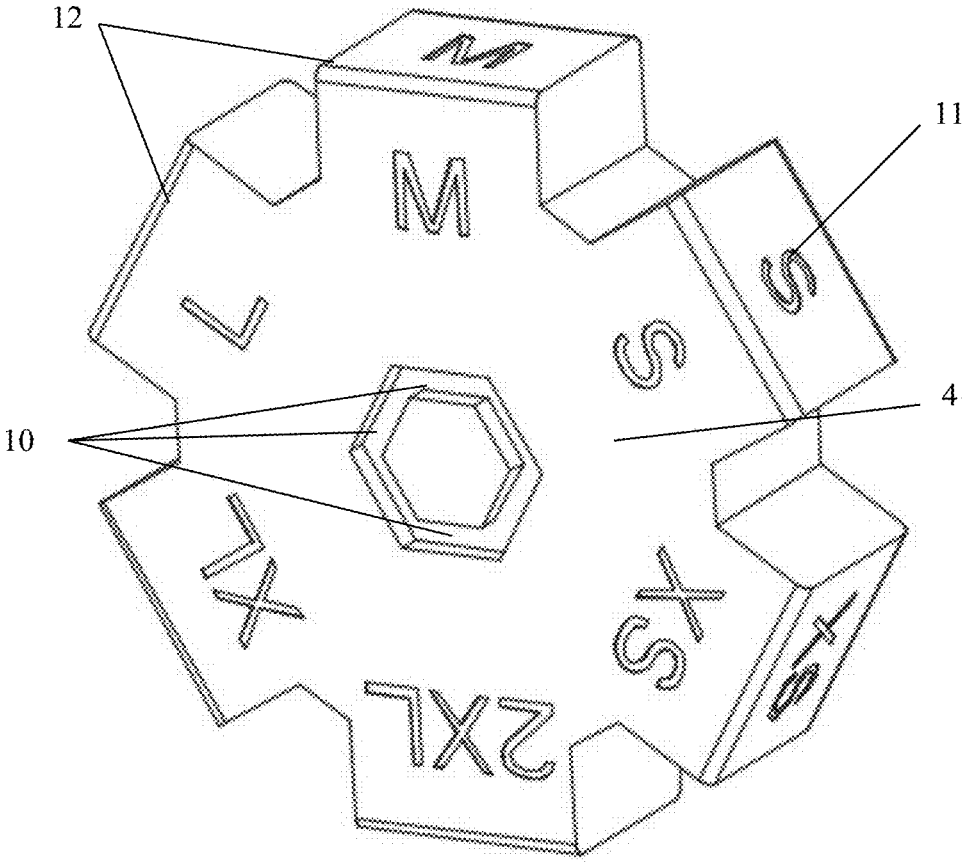
FIG. 6 shows a perspective view of the variable sizer.

FIG. 6 shows sizer 4's six slits 10 formed below said cogs 12 around the center of said sizer 4. Another set of slits 10 is on the reverse face of said sizer 4. Each slit 10 is oriented in a direct relationship to each indicia 11 so that said slit 10 is parallel to indicia 11's top edge. Together, slits 10 of said cogs 12 form a hexagon around the center of sizer 4, and each slit is configured to accommodate tab 8 formed on hanger 2 in a male-female arrangement, where tabs 8 serve as the male portions and slits 10 serve as the female portions.

Figure 7:
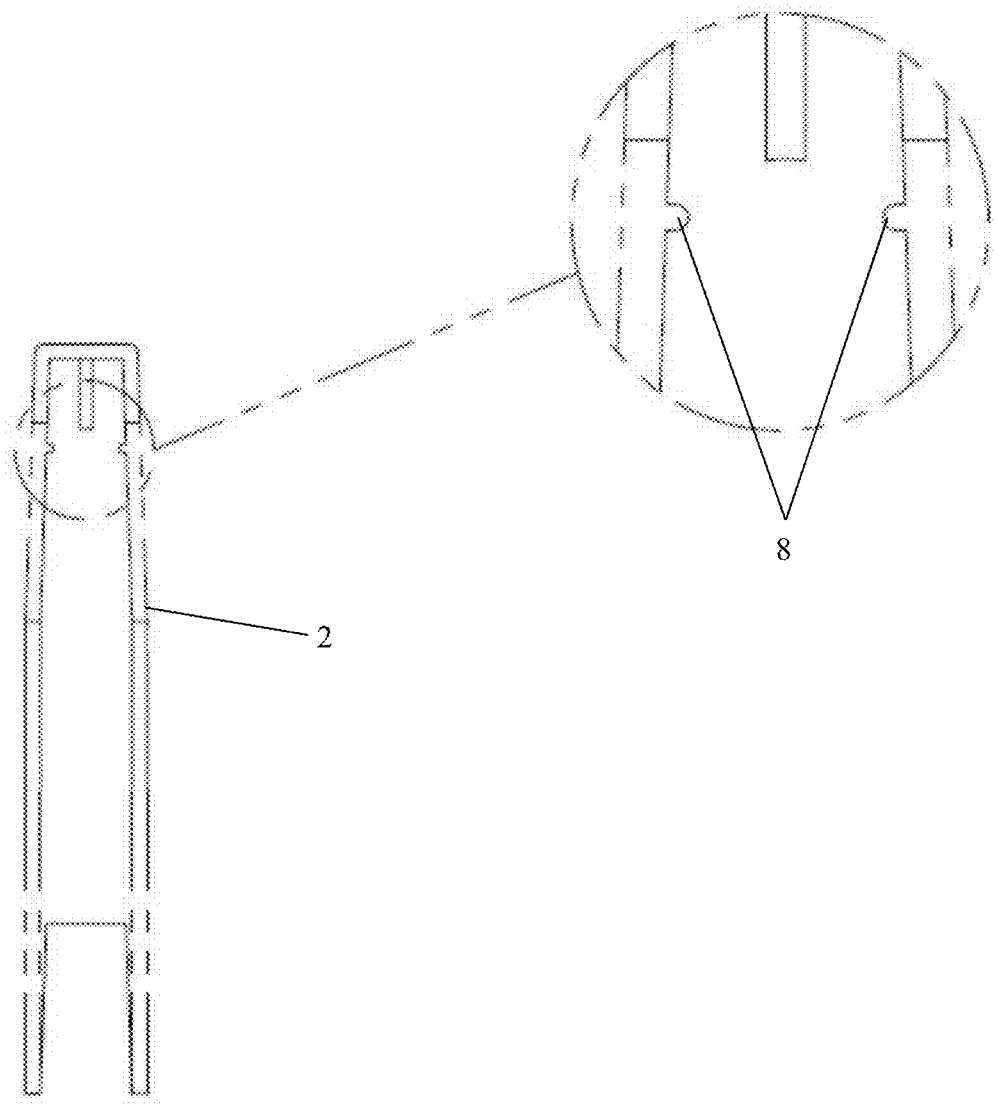
FIG. 7 shows a cross-section of the hanger of the present invention with a zoom-in of the tabs.

FIG. 7 shows hanger 2 in cross-section, with a detailed view of tabs 8 protruding on the inside of said hanger below opening 6. Tabs 8 serve as an immobilizing element below said opening 6 adapted to hold said display sizer in place when in use. Tabs 8 mate with sizer 4's slits 10 to immobilize sizer 4 inside hanger 2. Hanger 2's body is resilient enough to flex outwardly so that tabs 8 can hold sizer 4 by entering slits 10 of the corresponding cog 12.

In practice, the preferred embodiment of the present invention is used as following: referring to FIGS. 4 and 5, a user takes sizer 4 and finds the correct indicia 11 for the garment that will be displayed on hanger 2. Once user finds the correct indicia 11, user aligns said indicia 11 so that it is directly below opening 6. User inserts sizer 4 through the opening portion 6 of hanger 2's upside-down U shape until the correct indicia 11 is substantially flush with hanger 2's opening 6, and inserts sizer's slits 10 onto hanger 2's tabs 8 so that tabs 8 mate with slits 10. Hanger 2 is substantially resilient, and its body flexes outwardly as tabs 8 accommodate sizer 4's cog 12 as it passes through said tabs 8 until tabs 8 settle into slits 10. Once tabs 8 are inside slits 10, sizer 4 is immobilized in hanger 2 and is ready for use.

To change hanger 2's sizer 4 from one indicia 11 to another, the user pushes on sizer 4 through opening 6 forcing tabs 8 to release their grip on slits 10, flexing hanger 2's top portion slightly outwardly as sizer 4 passes between tabs 8, and sizer 4 can be removed. Hanger 2's elasticity permits to slide sizer 4 in and out of position with relative ease. User then chooses another indicia 11 on sizer 4 and repeats sizer 4's installation inside hanger 2.

The invention claimed is:

1. A variable size marker for a garment hanger comprising: a gear-shaped element provided with a plurality of garment display sizers formed in the shape of cogs, said display sizers extend from a central disk, each of said display sizers is provided with an indicia provided to display an individual size; said hanger comprises an opening formed in an upper portion of said hanger, wherein said opening is adapted to accommodate one display sizer, said hanger is provided with an immobilizing element below said opening adapted to hold said display sizer in place when in use.

2. The variable size marker according to claim 1, wherein said opening is of a square configuration and said display sizer is also of a square configuration.

3. The variable size marker of claim 1, wherein said immobilizing element comprises two horizontal flat rectangular tabs extending from inside opposing walls of said hanger below said opening, and said central disk is provided with corresponding slits adapted to accommodate said tabs.

4. The variable size marker according to claim 1, wherein said gear-shaped element comprises six cogs.

5. The variable size marker according to claim 1, wherein said hanger has an upside-down U-shape configuration.

6. The variable size marker according to claim 1, wherein slits are formed around a central portion of said central disk.

7. The variable size marker according to claim 6, wherein said slits are oriented in direct relationship to each cog so that said slits are parallel to said cogs.

8. The variable size marker according to claim 7, wherein said slits form a hexagon around the central portion of said central disk.

9. The variable size marker according to claim 8, wherein said immobilizing element comprises tabs, wherein said slits are configured to accommodate said tabs in a male-female arrangement, wherein said tabs operate as a male portion and said slits operated as a female portion.

10. A variable size marker for a garment hanger comprising: a gear-shaped element provided with six garment display sizers formed in the shape of cogs, said display sizers extend from a central disk, each of said display sizers is provided with an indicia provided to display an individual size; said hanger comprises an opening formed in an upper portion of said hanger, wherein said opening is adapted to accommodate one display sizer, said hanger is provided with an immobilizing element below said opening adapted to hold said display sizer in place when in use.

11. The variable size marker according to claim 10, wherein said opening is of a square configuration and said display sizer is also of a square configuration.

12. The variable size marker according to claim 10, wherein said immobilizing element comprises two horizontal flat rectangular tabs extending from inside opposing walls of said hanger below said opening, and said central disk is provided with corresponding slits adapted to accommodate said tabs.

13. The variable size marker according to claim 10, wherein said hanger has an upside-down U-shape configuration.

14. The variable size marker according to claim 10, wherein slits are formed around a central portion of said central disk.

15. The variable size marker according to claim 14, wherein said slits are oriented in direct relationship to each cog so that said slits are parallel to said cogs.

16. The variable size marker according to claim 15, wherein said slits form a hexagon around the central portion of said central disk.

17. The variable size marker according to claim 16, wherein said immobilizing element comprises tabs, wherein said slits are configured to accommodate said tabs in a male-female arrangement, wherein said tabs operate as a male portion and said slits operated as a female portion.

18. A variable size marker for a garment hanger comprising: a gear-shaped element provided with a plurality of garment display sizers formed in the shape of cogs, said display sizers extend from a central disk, each of said display sizers is provided with an indicia provided to display an individual size; said hanger comprises an opening formed in an upper portion of said hanger, wherein said opening is adapted to accommodate one display sizer, said hanger is provided with a resilient immobilizing element below said opening adapted to elastically hold said display sizer in place when in use.

19. The variable size marker of claim 18, wherein said resilient element is configured to flex outwardly when said display sizer is inserted and removed from said hanger.

20. The variable size marker of claim 18, wherein said immobilizing element comprises two horizontal flat rectangular tabs extending from inside opposing walls of said hanger below said opening, and said central disk is provided with corresponding slits adapted to accommodate said tabs.

* * * * *